US007856780B2

(12) United States Patent
Durnberger

(10) Patent No.: US 7,856,780 B2
(45) Date of Patent: Dec. 28, 2010

(54) PANELS HAVING A STRIP FLOORING LOOK

(75) Inventor: Gerhard Durnberger, StraBwalchen (AT)

(73) Assignee: Kaindl Flooring GmbH, Wals/Salzburg (AT)

( * ) Notice: Subject to any disclaimer, the term of this patent is extended or adjusted under 35 U.S.C. 154(b) by 191 days.

(21) Appl. No.: 11/814,016

(22) PCT Filed: Oct. 17, 2005

(86) PCT No.: PCT/EP2005/055308

§ 371 (c)(1),
(2), (4) Date: Jul. 16, 2007

(87) PCT Pub. No.: WO2006/074831

PCT Pub. Date: Jul. 20, 2006

(65) Prior Publication Data

US 2008/0066406 A1 Mar. 20, 2008

(30) Foreign Application Priority Data

Jan. 17, 2005 (DE) ..... 10 2005 002 295

(51) Int. Cl.
*B44F 9/00* (2006.01)

(52) U.S. Cl. ..... 52/313; 52/592.1; 52/589.1

(58) Field of Classification Search ..... 52/311.2, 52/384, 390, 592.1, 592.2, 589.1, 313; 428/195.1, 428/151

See application file for complete search history.

(56) References Cited

U.S. PATENT DOCUMENTS 769,664 A * 9/1904 Munro ..... 52/384
4,953,335 A * 9/1990 Kawaguchi et al. ..... 52/384
5,590,500 A * 1/1997 McCue ..... 52/311.2
5,606,841 A * 3/1997 Carter, Jr. ..... 52/802.1

(Continued)

FOREIGN PATENT DOCUMENTS

CA 2 363 184 A1 7/2001

(Continued)

*Primary Examiner*—Richard E Chilcot, Jr.
*Assistant Examiner*—James Ference
(74) *Attorney, Agent, or Firm*—Pearne & Gordon LLP

(57) ABSTRACT

The invention relates to panels having a decorative surface for forming a flooring, to a method for producing the decors and to a flooring made up of said panels. The invention finally relates to a decorative paper. The aim of the invention is to provide panels that allow to produce an inexpensive flooring having a high-quality appearance and to provide a corresponding method for producing them. For this purpose, the décor surfaces of panels on at least one end each are optically adapted to each other to such a degree that, when the panels are laid, they give a continuous image of the décor at the transition from one laid panel to the adjacent laid panel. The wood décor has a continuous image within the meaning of the invention if the grain of the depicted wood is optically uninterrupted at the transition from one laid panel to the adjacent laid panel, i.e. when there is no offset between the respective depicted grains. The same applies for other decors, for example stone decors. In this case, the images of the stone surface are adapted to each other at the transition from one laid panel to the adjacent laid panel in such a manner that one stone extends from the one panel to the next panel without any noticeable offset of the décor at the common joint of the panels.

10 Claims, 3 Drawing Sheets

U.S. PATENT DOCUMENTS

| | | | | |
|---|---|---|---|---|
| 5,625,990 | A * | 5/1997 | Hazlett | 52/311.2 |
| 5,744,220 | A * | 4/1998 | Ringo | 428/195.1 |
| 5,755,068 | A * | 5/1998 | Ormiston | 52/314 |
| 5,941,047 | A * | 8/1999 | Johansson | 52/747.1 |
| 6,119,423 | A * | 9/2000 | Costantino | 52/390 |
| 6,253,512 | B1 * | 7/2001 | Thompson et al. | 52/311.1 |
| 6,438,919 | B1 | 8/2002 | Knauseder | |
| 6,465,046 | B1 * | 10/2002 | Hansson et al. | 427/256 |
| 6,581,351 | B2 * | 6/2003 | DeVivi | 52/592.1 |
| 6,888,147 | B1 * | 5/2005 | Hansson et al. | 250/453.11 |
| 7,255,040 | B2 * | 8/2007 | Sjoberg | 101/33 |
| 2002/0014047 | A1 | 2/2002 | Thiers | |
| 2003/0009973 | A1 * | 1/2003 | Lee | 52/589.1 |
| 2003/0108717 | A1 * | 6/2003 | Sjoberg | 428/151 |
| 2003/0167717 | A1 | 9/2003 | Garcia | |
| 2003/0205012 | A1 * | 11/2003 | Garcia | 52/313 |
| 2004/0170812 | A1 | 9/2004 | Sjoberg | |
| 2004/0255541 | A1 | 12/2004 | Thiers et al. | |
| 2005/0144898 | A1 * | 7/2005 | Sjoberg | 52/745.19 |

FOREIGN PATENT DOCUMENTS

| | | | |
|---|---|---|---|
| DE | 203 13 350 | U1 | 12/2003 |
| WO | 2005/010296 | A1 | 2/2005 |

* cited by examiner

PANELS HAVING A STRIP FLOORING LOOK

BACKGROUND OF THE INVENTION AND RELATED ART

The invention relates to panels having a decorative surface for forming flooring, to a method for producing the decors or visual indicia and to flooring made up of said panels. The invention also relates to a decorative paper.

In order to be able to easily transport and lay a flooring, this is, as a rule, formed from individual panels. Panels are, as a rule, firmly bonded to the subsurface and/or joined at the sides, for example by means of tongues and grooves. Laying is particularly easy when the coupling elements of panels, at the sides, are designed so that they can be joined together without adhesive. Various suitable adhesive-free connections of panels with a decorative surface are known from the Austrian patent AT 405 560 B.

A printed decorative paper usually determines the appearance of a laminate floor, As a rule, these are system decors, namely primarily wood reproductions, but also stone or fantasy images, for example with floral motifs. System decor is understood to mean that the printed image is adapted to fit the finished panel size. As a rule, these panels are about 1200-1400 mm long and about 200 mm wide. A 3-plank decorative print, for example known from WO 02/090129 A1, is designed, for example, so that three visible planks on the finished panel are each of equal width, and no so-called blocks (boards shorter than 50 mm) are formed at the ends (in the longitudinal direction). However, the decorative image ends with the panel length in each case.

A panel length of about 1200 mm has proved its worth. Manufacture, storage, transport, point of sale and laying are relatively easily possible with this length. Disadvantageously, however, the decorative pattern is limited to this length in each case.

Decorative laminate panels of the kind mentioned at the beginning, the decorative layers of which represent wood or minerals such as marble or granite, for example, are known from the publication DE 297 24 625 U1. In order to make the reproduction appear more realistic, the surface is provided with a structure, which reproduces the characteristic features of the pattern. In the case of a mineral, for example, this is a coarse, three-dimensional surface in order to reproduce a roughly polished stone. In the case of wood, pores are pressed into the decorative surface in order to imitate the pores of natural wood.

Further, it is known from the publication DE 297 24 625 U1 that the pattern of one panel must, as a rule, not be the same as the pattern of a second panel, as wood or stone also continuously exhibit at least a slightly changed appearance. With floorings formed of such panels, the transition from one panel to another is basically clearly visible, as the decors on the narrow and long sides of the panel are not, as a rule, matched with one another. A kind of block formation, often unintentionally, determines the appearance of the surface of the flooring.

Wooden floorboards with a rectangular surface are available commercially. The floorboards are elongated. When laid, one board usually extends from one wall of a room to an opposite wall without interruption. In this way, a continuous appearance of the surface is produced parallel to the long side of the respective floorboard. Disadvantageously, floorboards of this kind are however very expensive.

From the publication WO 02/090129 A1, it is known to visually match the surface pattern of a decorative layer on the narrow side of a panel with the surface pattern of a narrow side of an adjacent panel. This is intended to prevent the transition from one panel to the next being easily visible. Panels are provided with numbers for this purpose. The numbering must be taken into account when laying. It is therefore not possible to combine panels freely with one another during laying if panels in the flooring are to be invisible as far as possible, and if the formation of blocks is to be avoided.

SUMMARY OF THE INVENTION

The object of the invention is to provide panels with which a high-quality appearance of a flooring can be produced inexpensively. Furthermore, the object of the invention is to disclose a manufacturing method.

In accordance with the above objectives, the decor surfaces and visual indicia of the panels, on at least one side each at a pattern end portion are visually matched with each other to such a degree that, a continuous image of the decor results at the transition from one laid panel to the adjacent laid panel. The wood decor has a continuous image according to the invention if the grain of the depicted wood is visually uninterrupted at the transition from one laid panel to an aligned adjacent laid panel. That is, there is no offset between the respectively depicted grains and the grains thereby cooperate to provide transition indicia alignment at abutting panel ends. The same applies for other decors, for example stone decors. In this case, the images of the stone surface are matched with each other at that transition from one laid panel to an adjacent laid panel in such a manner that one stone continues from the one panel to the next panel without a clearly visible offset at the decor at the common joint of the panels.

The same applies to fantasy decors, for example floral motifs. When laid, there is then a transition from one panel to the next in which visible images from the one panel to the adjacent panel exhibit no offset.

Preferably, in panels with rectangular surfaces, the transition indicia and alignment of the panels with offset-free transitions of the decors according to the invention are provided along the narrow sides and panel end portions. If panels are laid so that the narrow sides of two panels abut, then the narrow sides basically always have the same position relative to one another enabling alignment of the transition indicia. This is only true in the case of the long sides if attention is specifically paid to this when laying or installing the floor panels. If, therefore, particularly easy laying or installation is to be possible, with which no special attention is paid to the relative positions of panels with respect to one another, then the inventive offset-free transition of the decors between two panels must be provided at the narrow sides.

In one embodiment of the invention, the decors can alternatively or additionally also be matched with one another on the long sides in the manner according to the invention. This means, however, that, comparable to hanging strips of a photographically printed wallpaper, attention must be paid when laying to the fact that the respective position of the panels must be matched to one another in order to avoid making a transition from one panel to the adjacent laid panel visible due to an offset in the respective illustration.

According to the invention, it is therefore possible that the decorative top layer results in an endless visual effect when laid. According to the invention, this applies mainly to wood reproductions, as a continuous visual effect then resembles the floorboards mentioned at the beginning, and in this way a particularly high-quality impression is conveyed. A similar argument applies for stone reproductions. The larger the flags used for a stone floor are, the more expensive the flooring is. If the same visual impression is produced by means of the panels according to the invention, that the floor is one with particularly large stone flags, then the floor flooring would be perceived to be of particularly high quality.

Advantageously, this visual appearance is advantageously supported by a surface structure synchronous with the decor. The structure then also merges at the panel ends without offset.

Particularly in order to reinforce the impression of a boarded floor, panels have a recess on at least two sides, namely preferably adjoining to long sides. The recess is designed so that a depression is provided at the transition from one laid panel to an adjacent laid panel, which typically resembles a "V". The transition at the long sides of panels, which as a rule is visually determined by an offset of decors, can in this way be deliberately reinforced by an additional visual element. An intentional decorative character of a "V"-shaped transition is produced, which simulates the character of country house floors. From a technical point of view, such a recess has the advantage that slight height differences between two panels are not noticed on the decorative surface, which could otherwise be the case if panels do not have a deliberately provided recess at the transition from one long side to the next.

A recess within the meaning of the present invention is known, for example, from the publication DE 03012041 A1. The recess in the form of a V-groove known from this, however, has a different purpose.

In order to reinforce a natural impression, different panels have different patterns or visually different indicia at pattern central portions that extend between pattern end portions. At least one pattern of a panel therefore differs with regard to its pattern or decor from at least one further panel. This makes that the decor of the flooring, for example of a floor, more varied. If natural materials such as stone, wood or cork are imitated, then this reinforces the natural impression.

In order to be able to lay panels easily, the decors on opposite edge areas are designed so that two panels can be laid adjacent to one another such that an offset-free transition within the meaning of the invention is possible. In particular, there are then lines, which continue without offset at the transition from one panel to an adjacent laid panel. This applies primarily to the narrow sides of panels with rectangular surface. Unlike the prior art, it is then not necessary to pay attention to a numbering of panels.

In order to avoid the impression of repetitive patterns, lines in the decor preferably run essentially parallel to the narrow sides of a panel, for example, and/or parallel to the two long sides of a panel with a rectangular surface. The lines in the decorative surface can be produced by gradations in color and also by means of structures in the sense described at the beginning. Inaccuracies in manufacture are considerably less noticeable when the lines run parallel to two sides of a panel. The pattern of one panel then differs from the pattern of another panel due to a different progression of the lines outside of the edge area with the parallel running lines.

In the following, the above-mentioned edge area is referred to as the "matching piece" or pattern end portion. According to the invention, a matching piece of one panel "matches" the matching piece of another with regard to the decor and transition indicia. From a visual point of view, there is an offset-free transition of the decors between two matching pieces, namely primarily with regard to colors and/or lines, but also with regard to structures in the sense described at the beginning.

Parallel running lines in the area of the matching pieces are provided primarily in the case of wood decors. It has been found that repeating patterns in the area of the matching pieces remain visually unobtrusive, namely primarily when panels are 1200 to 1400 mm long and the matching pieces are provided on the narrow sides.

In order to avoid the impression of repetitive decors or patterns, a matching piece extends over a comparatively short distance compared with the total length of a panel. Measured from a narrow edge of a panel, the distance is preferably just a few cm, for example not more than 20 cm, in fact particularly when a panel is otherwise at least 100 cm long in the extended direction.

Particularly in the case of a reproduction of a stone floor, the panels are preferably at least 30 cm, particularly preferably at least 40 cm wide. In this way, the impression of broad and elongated stone flags is given regardless of whether a visual offset between laid panels is visible on the long sides or not, Particularly when country house floors are imitated, the typical width of about 200 mm mentioned at the beginning is sufficient.

In a further preferred embodiment, the patterns or decors are designed so that laid panels have a plurality of endless lines. This means that, when laid, a line does not finish until the edge of a flooring. Particularly in the case of a wood reproduction, this gives the impression of a particularly high-quality floor. As a rule, a line then corresponds to the grain of a wood, caused by annual rings.

In the case of a stone floor reproduction, lines also preferably run in an endless manner. Unlike wood floor reproduction, the appearance is generally reinforced by ring-shaped lines and/or circular areas and less so by lines that extend from one edge of the flooring to an opposite edge of a flooring.

The decor can be formed by printed paper, but also by other printed or painted materials such as metal, plastic or wood-based materials. Particularly in the case of floors, an abrasion-resistant layer with an IP value of at least 1800 revolutions in accordance with the standard EN 13329 is located above the decor. A decor can be formed by surface lacquers, which are cured by UV or electron beam, namely, for example, in the manner known from WO 02/28665 A1.

Panels of the kind according to the invention can be laid in very different ways. It is possible to bond panels firmly to the subsurface, for example by gluing. Panels can be joined together at the sides by tongues and grooves. A glued tongue and groove joint is possible. However, an adhesive-free joint between two panels is to be preferred, as is known, for example, from AT 405 560 B or from WO 01/48332 A1. Panels of the kind according to the invention can have in their joints a protective medium against the penetration of moisture into the joint, for example a paste, oils, waxes or other viscous water-repelling compound, in order to prevent damage due to moisture penetration. Panels of the kind according to the invention can have a surface that is a good electrical conductor, for example by means of carbon additives, in order to prevent electrostatic charging. Panels of the kind according to the invention can include footfall-sound insulating or tone-improving materials, for example thermoplastics. The footfall-sound insulating or tone-improving materials can form a bottom, top and/or middle layer of a panel. By providing a tone-improving or footfall-sound insulating material, the perception of noise when walking on a flooring is more pleasant. Panels of the kind according to the invention can include a carrier board on which the decorative layer is applied. There can be a layer underneath the board that counteracts warping of the panels. This layer is preferably made from the same material as the decorative layer, i.e., for example from paper.

DETAILED DESCRIPTION OF THE DRAWINGS

The invention is described in more detail below with reference to an exemplary embodiment.

Figure 1:
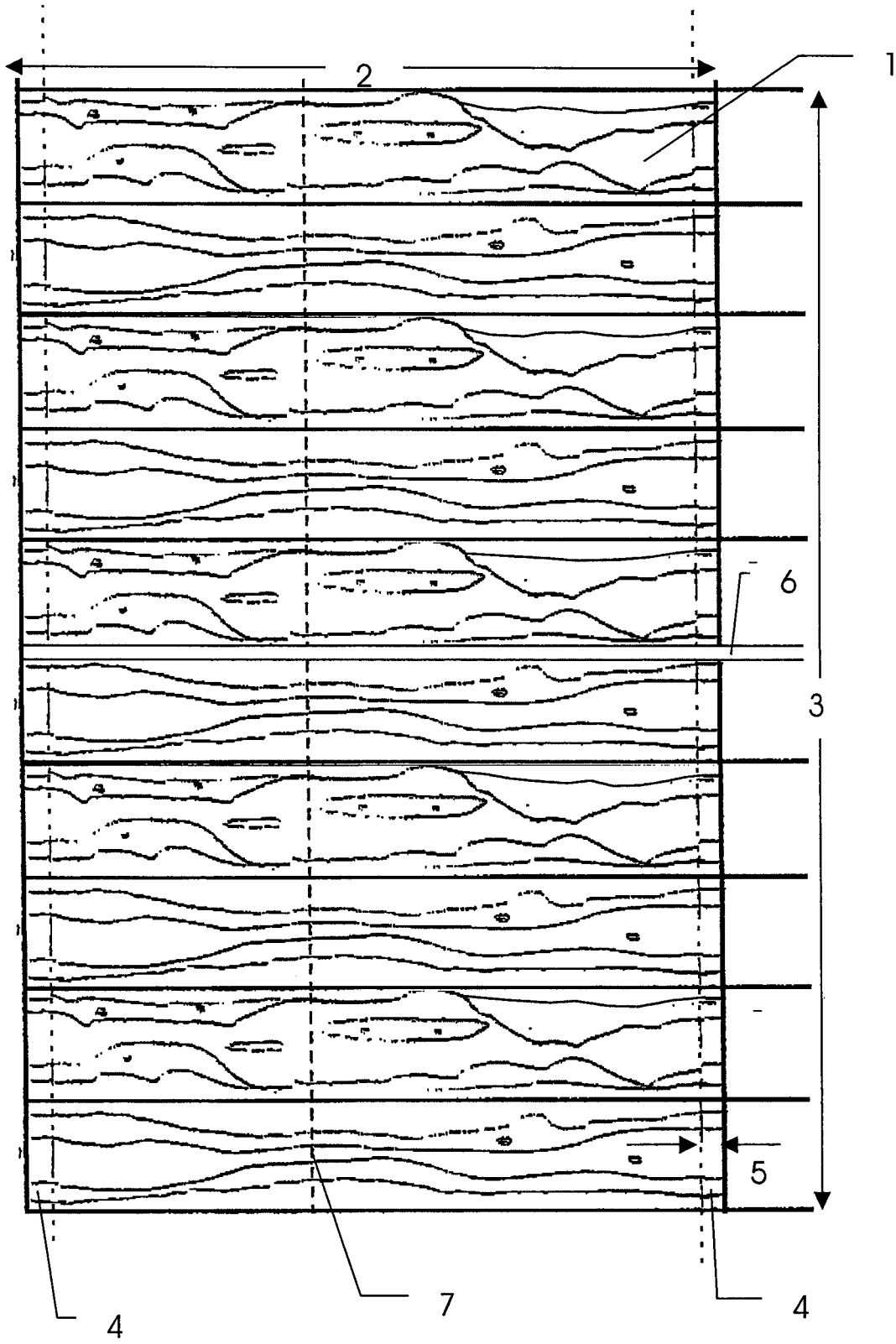
FIG. 1 is a plan view of a decorative paper having a printed surface including transition indicia in accordance with the invention and suitable for attachment to floor panels.

A decorative paper 1 shown in FIG. 1 is manufactured using the gravure printing method with an impression cylinder. The circumference of the cylinder corresponds to a panel length 2. The cylinder width 3 exceeds that width of a panel to be manufactured by several times. FIG. 1 shows the case where, taking into account the changing dimensions during impregnation and the cut allowances, the width of the impression cylinder covers the width of ten panels. With the help of digital image processing, which forms the basis for cylinder engraving, the decorative image is designed so that this is identical at each end of the panel. This results in the so-called matching pieces or pattern end portions 4. This makes it possible for the decors of the panels to be essentially different along pattern central portions between the pattern end portions, but to match each other exactly at each end via the aligned grain depictions or transition indicia, and for the decorative image to continue visually beyond the panel ends. In this way, the visual decorative image can continue endlessly when laid. The length 5 of the matching pieces (that is to say the visually identical decorative ends or pattern end portions) is adapted to suit the manufacturing process and the manufacturing tolerances resulting from this. In the case of panels with the usual length stated at the beginning, it has been shown to be advantageous if the matching pieces extend for at least 80 mm parallel to the long sides of the subsequent panels, i.e. are at least 80 mm long.

In a wood decor, the wood grain in the area of the matching pieces 4 runs substantially parallel to the longitudinal edges or the long sides of a subsequent panel. Furthermore, the matching pieces 4 should be as short as possible, so that this area of the decor does not stand out in an irritating manner. This must already be taken into account with the template, namely an original material, for example a wood, which is scanned. The decor of the matching pieces 4 can then be seamlessly joined to the remaining decor.

The individual panels therefore are in harmony with each other with regard to their basic character (color, surface treatment and structure). The matching piece 4 is incorporated at the respective panel ends. Between two matching pieces 4, the decors differ from one another. Two different grains of a wood are shown by way of example in FIG. 1.

The decorative paper is impregnated with resin and joined to a carrier board by pressing. The layers to be pressed can also include an abrasive-resistant layer, consisting, inter alia, of a melamine resin and corundum powder, applied to the decorative paper, and a transparent covering layer.

The decorative paper 1 is provided additional markings and lines, which are used to control the later production process, for example a center line 6. The center line 6 is used in particular to align a saw, which cuts out the panels lengthwise from a board with the decorative paper 1 affixed to it.

In order to be able to handle decorative papers more easily, a paper web is separated along a line 7, for example. A separated paper then includes the decor of 4 times 10 panels, for example.

A employed press plate is structured synchronously with the decorative image and gives a synchronous surface to the product. The matching pieces 4 previously mentioned are also present or considered in the press plate.

In the case of wood decors, pores, which are matched to the printed grain of a wood according to position, are pressed into the decorative paper 1 by the press plate. For example, the decor can be the reproduction of a brushed pine in which the different annual rings are shown in the decor.

At the sides, the decorative paper includes auxiliary markings, which are not shown and which serve to align the paper relative to the press plate while the pores are being pressed. This enables the run and arrangement of pores to be synchronized with the run of the printed grain in a very easy and therefore inexpensive manner in order to better imitate the surface of a wood.

In order to be able to carry out a quality check, in a preferred embodiment, the decorative paper has geometrical figures (not shown), such as for example one or more rhombuses, in the area of the center line, for example, Geometrical figures of this kind, that is to say rhombuses for example, are also arranged synchronously in the press plate. After pressing the paper, it can be checked whether the rhombuses printed on the paper coincide with regard to their position with the rhombuses pressed into the paper. The measure of coincidence is a measure for the extent to which the structure embossed into the paper is synchronized with the visual decor.

Figure 2:
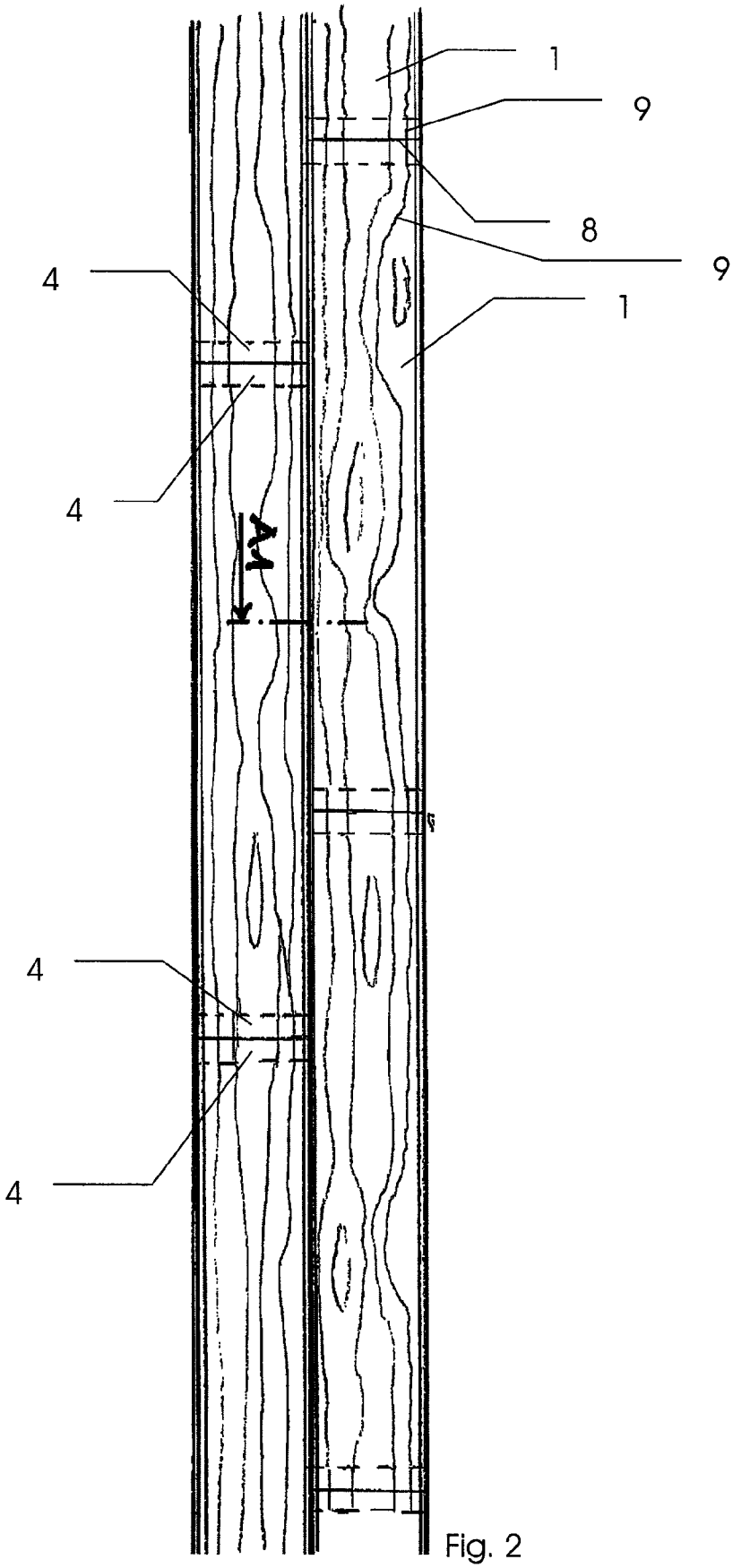
FIG. 2 is a plan view of installed floor panels having the decorative paper of the invention.

FIG. 2 shows laid panels in plan view. If two panels with decors 1 abut with their narrow sides 8, then this is not noticeable from the run of the printed grain or lines 9. The lines 9 are not offset at the transition of one laid panel to the subsequent panel, which adjoins a narrow side.

Figure 3:
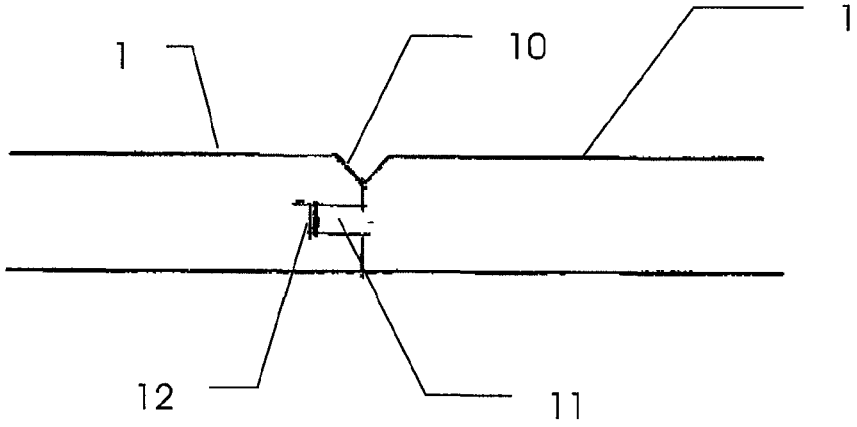
FIG. 3 is in a sectional view taken along the line Al in FIG. 2.

FIG. 3 shows a section A1 through the panels with their respective decors 1 shown in FIG. 2. On their long sides, the panels have recesses 10 in such a way that these form a "V" together with the recesses 10 of adjacently laid panels. In this way, the transitions from one panel to an adjacent laid panel also have a particular visual effect on their long sides, which furthermore offers technical advantages for the reasons stated. Height differences between panels are then not noticeable at the transition from one panel to the adjacently laid panel on the long sides.

By way of an example, FIG. 3 shows a tongue 11 and a groove 12, which can be glued together, in order to join the panels 1 firmly to one another. It is to be preferred, however, that tongue and groove be additionally provided with locking elements, which enable an adhesive-free joint to be made, in the manner known from AT 405 560 B, for example.

Figure 4:
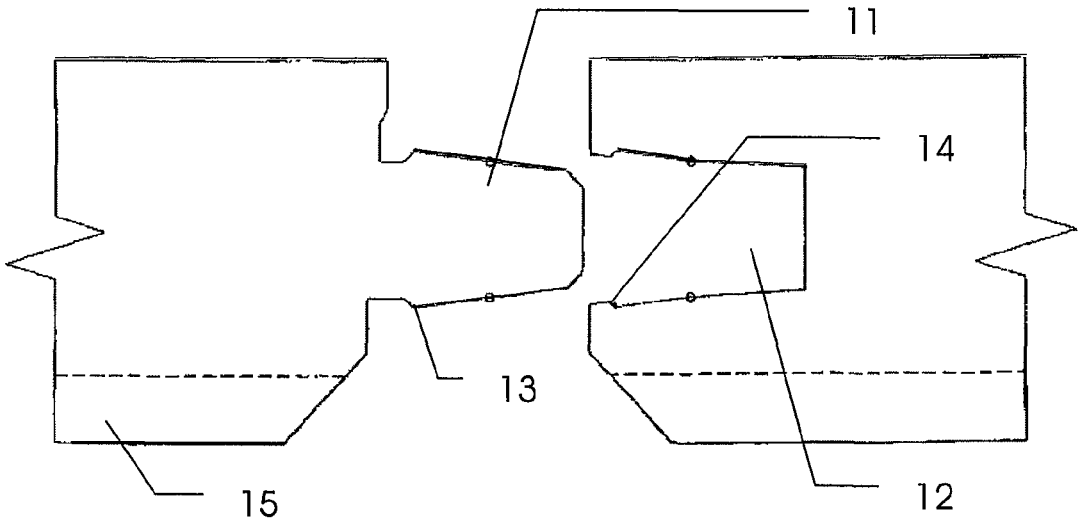
FIG. 4 is an example of an adhesive-free joint with the joint elements spaced apart for purposes of illustration.

FIG. 4 shows an example of an adhesive-free joint within the meaning of the invention. Tongue 11 and groove 12 are provided with additional locking elements 13 and 14, which make a positive-fit joint parallel to the surface of the flooring possible. A footfall-sound insulating layer 15 is applied underneath the panel.

The invention claimed is:

1. Flooring comprised of rectangular panels having long sides, narrow ends and top surfaces formed by panel patterns including lines and different colored areas comprising:

(a) a plurality of said panels to be installed in adjacent relationship to form a floor covering, each of said panel patterns including pattern end portions at said narrow ends extending to a pattern central portion disposed along said long sides, said pattern end portions being visually identical and including panel transition indicia for panel alignment at all narrow ends, said pattern central portions including visually different indicia so that different panels have visually different top surfaces, (b) said transition indicia including a plurality of said lines extending to said narrow ends of said panels for alignment with transition indicia of an abutting narrow panel end, (c) upon alignment of said panels, said plurality of lines having a continuous appearance extending between the abutting narrow ends to thereby merge said panel patterns into one another without offset of the transition from one panel to another adjacent panel, and (d) said plurality of panels having said narrow ends in abutting relationship and said long sides in abutting relationship to provide said flooring and said floor covering, wherein said transition indicia plurality of lines includes spaced pairs of lines parallel to said long sides of said panel, and whereby when said narrow end of any of a first panel abuts said narrow end of any of a second panel in the flooring, said transition indicia align to form continuous lines throughout the length of said flooring.

2. Flooring according to claim 1, wherein said transition indicia plurality of lines have a length equal to not more than 20 cm corresponding to 50.8 inches.

3. Flooring comprised of rectangular panels having long sides, narrow ends and top surfaces formed by panel patterns including lines and different colored areas comprising:

(a) a plurality of said panels to be installed in adjacent relationship to form a floor covering, each of said panel patterns including pattern end portions at said narrow ends extending to a pattern central portion disposed along said long sides, said pattern end portions being visually identical and including panel transition indicia for panel alignment at all narrow ends, said pattern central portions including visually different indicia so that different panels have visually different top surfaces, (b) said transition indicia extending to said narrow ends of said panels for alignment with transition indicia of an abutting narrow panel end, (c) said transition indicia of said abutting narrow ends, upon alignment of said panels, having a continuous appearance extending between the abutting narrow ends to thereby merge said panel patterns into one another without offset of the transition from one panel to another adjacent panel with respect to said lines and colored areas, and (d) said plurality of panels having said narrow ends in abutting relationship and said long sides in abutting relationship to provide said flooring and said floor covering, wherein said transition indicia includes a plurality of said lines extending to said narrow end and arranged generally parallel to said long sides, and whereby when said narrow end of any of a first panel abuts said narrow end of any of a second panel in the flooring, said transition indicia align to form continuous lines throughout the length of said flooring.

4. Flooring according to claim 3, wherein said transition indicia of said pattern end portions is joined without interruption to said visually different indicia of said pattern central portions.

5. Flooring according to claim 3, wherein said transition indicia comprises at least a portion of said lines and colored areas.

6. Flooring according to claim 3, further including providing said plurality of panels with visible recesses that extend along said abutting long sides of said adjacent panels.

7. Flooring according to claim 3, further including providing said visible recesses with lacquered surfaces.

8. Flooring according to claim 3, further including providing said lines with surface textures comprising surface depressions that extend along said lines.

9. Flooring according to claim 3, further including providing said lines in substantially parallel relationship.

10. Flooring according to claim 3, further including providing said top surface or panel pattern with the visual appearance of a wood surface or a stone surface.

* * * * *